US012686554B2

(12) United States Patent
Schultz et al.

(10) Patent No.: US 12,686,554 B2
(45) Date of Patent: Jul. 21, 2026

(54) HANDHELD SYSTEM AND METHOD FOR HEATING AND DISPENSING SHAVING FLUID

(71) Applicant: James A. Schultz, Syracuse, NY (US)

(72) Inventors: James A. Schultz, Syracuse, NY (US); Timothy G. Schultz, Ooltewah, TN (US); Derk Jan Stefan Hamminga, Espoo (FI)

( * ) Notice: Subject to any disclaimer, the term of this patent is extended or adjusted under 35 U.S.C. 154(b) by 205 days.

(21) Appl. No.: 18/439,063

(22) Filed: Feb. 12, 2024

(65) Prior Publication Data

US 2025/0256911 A1 Aug. 14, 2025

(51) Int. Cl.
*B65D 83/72* (2006.01)

(52) U.S. Cl.
CPC ..... *B65D 83/72* (2013.01)

(58) Field of Classification Search
CPC ..... B05C 5/001; B05C 11/1042; B05C 17/00523; B05C 17/00546; B67D 3/0022; B67D 7/80; Y10T 137/6606; B65D 83/72
See application file for complete search history.

(56) References Cited

U.S. PATENT DOCUMENTS 1,914,868 A * 6/1933 Rolstad ..... A45D 27/12 239/311
2,610,090 A * 9/1952 Johnson ..... A45D 27/10 366/604
3,997,083 A 12/1976 McNair
D308,117 S 5/1990 Badgett
6,056,160 A 5/2000 Carlucci
6,655,552 B2 12/2003 Aiken
6,978,912 B2 12/2005 Taylor
7,201,294 B2 4/2007 Carlucci
D776,955 S 1/2017 Auwles
9,826,823 B1 * 11/2017 Velazquez ..... A46B 11/08
11,304,490 B2 * 4/2022 Screnci ..... A45D 40/0081
2019/0299465 A1 * 10/2019 Gester ..... B26B 21/48
2021/0307481 A1 * 10/2021 Linton ..... A45D 27/02
2022/0211159 A1 7/2022 Linton

OTHER PUBLICATIONS

Web document of Bold-Products, titled "Conair Hlm5cs Compact Hot Lather Cap Heating System—Bold-Products USA," dated 2023.
Web document of tasalon.com, titled "Celebrate Father's Day with the Perfect Grooming Gift: The Comfortable Hot Lather Machine for Men," dated Jun. 15, 2023.
Web document of ynetnews.com, by Amir G., titled Hot Lather Machine—Enhance the Shaving Experience with Lather Time, dated Jan. 26, 2024.

* cited by examiner

*Primary Examiner* — Donnell A Long

(57) ABSTRACT

A handheld, watertight system can dispense heated skincare fluid, such as shaving fluid, promptly. A user can initiate dispensing shaving fluid, for example via actuating a dispensing valve associated with a pressurized vessel containing shaving fluid. The system can comprise a predictor that predicts or anticipates when the user will dispense heated shaving fluid and can initiate heating in advance of the user actuating the dispensing valve or otherwise prompting the system to dispense heated shaving fluid. In some disclosed examples, the system can utilize a battery, a heating coil, a pulse width modulator, a feedback control loop, and/or an executable control algorithm in support of heating shaving fluid.

19 Claims, 6 Drawing Sheets

HANDHELD SYSTEM AND METHOD FOR HEATING AND DISPENSING SHAVING FLUID

TECHNICAL FIELD

Embodiments of the technology relate generally to heating shaving fluid and more particularly to a handheld system for heating and dispensing shaving fluid, such as shaving cream, wherein the system may utilize energy from a battery for heating and may comprise a digital controller or an executable control algorithm that addresses deadtime.

BACKGROUND

In many respects, conventional technologies underserve heating shaving fluid and dispensing heated shaving fluid. For instance, need exists for a capability to heat and dispense shaving fluid from a system that is sufficiently compact to be handheld and/or sufficiently watertight to be used in a shower or bathtub.

Need further exists for a capability to dispense heated shaving fluid promptly. Need further exists for a capability to manage or reduce deadtime, time lag, or time delay between a user initiating dispensing of heated shaving fluid and the user receiving heated shaving fluid. Need further exists for a capability to manage or reduce an amount of unheated shaving fluid that may be dispensed in advance of dispensing heated shaving fluid. Need further exists for a capability to improve temperature uniformity along a stream of heated shaving fluid that is being dispensed, for instance into the user's hand. Need further exists for a capability to improve temperature uniformity of a bolus of shaving fluid that has being dispensed. Need further exists for a capability of controlling temperature of heated shaving fluid, such as by reducing deviation between desired temperature and actual temperature of heated shaving fluid.

The aforementioned needs are representative rather than exhaustive. A technology addressing one or more of the needs discussed above, or some related deficiency in the art, would benefit skin care and personal hygiene. As will be appreciated by those having skill in the art, the disclosure provided herein includes written description containing clear, exact terms to enable carrying out embodiments meeting the foregoing needs.

SUMMARY

A system can heat and/or dispense heated skincare fluid or fluids. In some aspects of the disclosure, the skincare fluid comprises a shaving fluid. In some aspects of the disclosure, the shaving fluid comprises shaving cream, shaving gel, shaving soap, shaving oil, shaving foam, shaving lather, or shaving soap (some representative examples rather than an exhaustive list). In some aspects of the disclosure, the skincare fluid comprises a liquid, a gel, an oil, a suspension, a paste, a lather, or a foam. In some aspects of the disclosure, the skincare fluid comprises a combination of two or more of a liquid, a gel, an oil, a suspension, a paste, a lather, and a foam. In some aspects of the disclosure, the skincare fluid is viscous. In some aspects of the disclosure, the skincare fluid is nonviscous. In some aspects of the disclosure, the skincare fluid comprises a cleansing fluid, for example shower gel, hand soap, or body wash. In some aspects of the disclosure, the skincare fluid comprises a disinfecting fluid. In some aspects of the disclosure, the skincare fluid comprises an antimicrobial fluid.

In some aspects of the disclosure, the system can be handheld. In some aspects, the system can be watertight or operable in a shower or bath. In some aspects, the system can be battery powered. In some aspects, the system can comprise a pressurized vessel containing shaving fluid, such as an aerosol can of shaving cream. In some aspects, the system can be housed in or packaged as a cap that snaps on and off an aerosol can of shaving fluid or other portable, pressurized vessel containing shaving fluid.

In some aspects of the disclosure, a user can initiate dispensing shaving fluid from the system, for example by actuating a dispensing valve associated with a pressurized vessel containing shaving fluid. In some subaspects, the system can respond by promptly dispensing heated shaving fluid. In some subaspects, the system can support low-latency delivery of heated shaving fluid. In some subaspects, the system can predict or anticipate when the user will dispense heated shaving fluid and can initiate heating in advance of the user actuating the dispensing valve or otherwise prompting the system to dispense heated shaving fluid. In some subaspects, the system can manage or reduce deadtime, time lag, or time delay between the user initiating dispensing of heated shaving fluid and the user receiving heated shaving fluid. In some subaspects, the system can comprise a temperature sensor, a predictor, and/or a dispensing sensor to support controlled heating of shaving fluid. In some subaspects, the system can comprise a feedback control loop that controls heating of shaving fluid. In some subaspects, the system can comprise a digital controller or an executable control algorithm that controls heating of shaving fluid. In some subaspects, the system can comprise a heating coil operably coupled to a pulse width modulator that electrically powers the heating coil in collaboration with the feedback control loop, the digital controller, or the executable control algorithm.

The foregoing discussion about heating shaving fluid is for illustrative purposes only. Various aspects of the present disclosure may be more clearly understood and appreciated from a review of the following text and by reference to the associated drawings and the claims that follow. This Summary does not intend to be exhaustive, nor does it intend to enumerate each and every aspect of the disclosure. Other aspects, systems, methods, features, advantages, and objects of the present disclosure will become apparent to those with skill in the art upon examination of the following drawings and text. It is intended that all such aspects, systems, methods, features, advantages, and objects are to be included within this description and covered by this paper and by the appended claims.

Figures 1A, 1B, 1C:
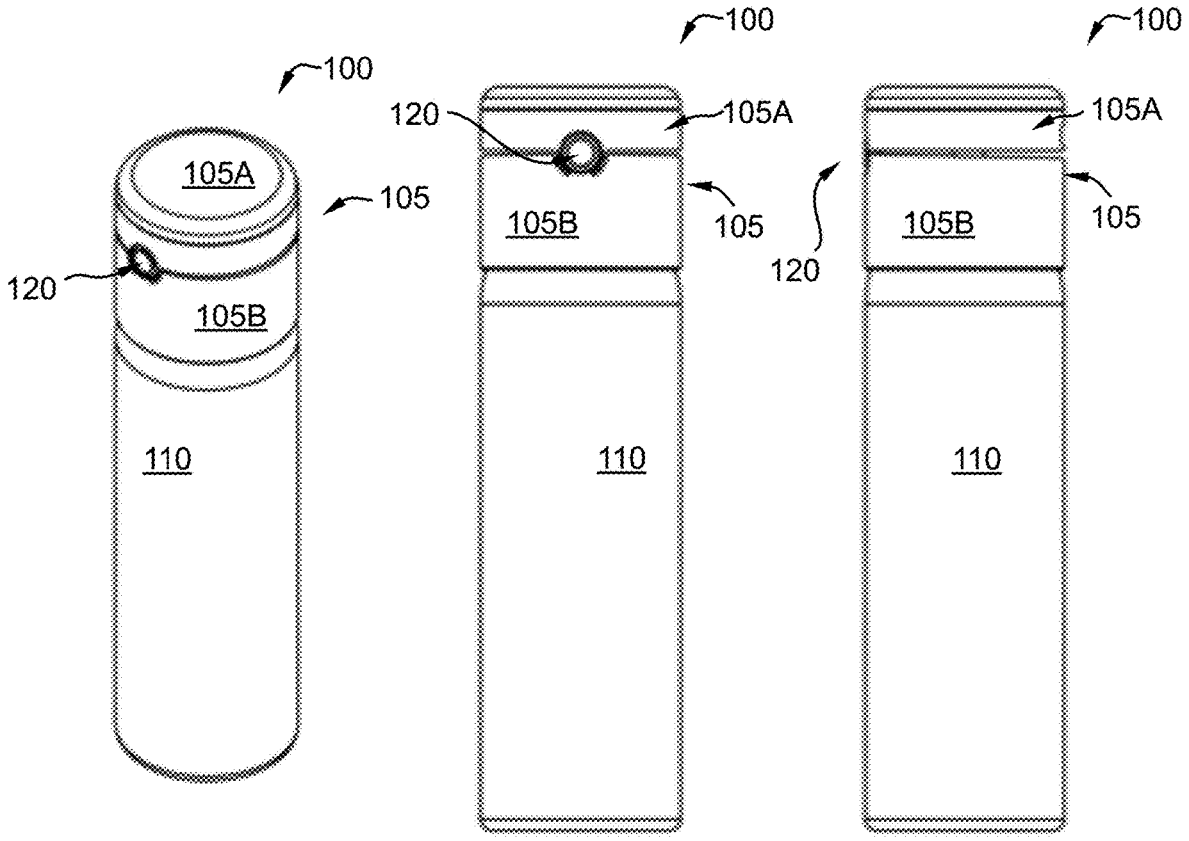
FIGS. 1A, 1B, and IC (collectively FIG. 1) are illustrations of a handheld system for heating and dispensing shaving fluid in accordance with some example embodiments of the disclosure.

Many aspects of the disclosure can be better understood with reference to these figures. The elements and features shown in the figures are not necessarily to scale, emphasis being placed upon clearly illustrating principles of example embodiments of the disclosure. Moreover, certain dimensions and features may be exaggerated to help visually convey such principles. In the figures, reference numerals often designate like or corresponding, but not necessarily identical, elements throughout the several views.

DETAILED DESCRIPTION OF EXAMPLE EMBODIMENTS

The technology will be discussed more fully below with reference to the Figures, which provide additional information regarding representative or illustrative embodiments of the disclosure. The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," and "exemplary embodiments" provided herein are intended to be non-limiting and among others supported by representations of the disclosure.

Those of ordinary skill in the art having benefit of this disclosure will be able, without undue experimentation, to combine compatible elements and features that are described at various places in this written description, which includes text and illustrations. That is, the illustrations and specification are organized to facilitate practicing numerous combinations, such as by combining an element of one illustrated embodiment with another element of another illustrated embodiment or by combining a feature disclosed in an early paragraph of the specification with another feature disclosed in a later paragraph of the specification.

This document includes sentences, paragraphs, and passages (some of which might be viewed as lists) disclosing alternative components, elements, features, functionalities, usages, operations, steps, etc. for various embodiments of the disclosure. Unless clearly stated otherwise, all such lists, sentences, paragraphs, passages, and other text are not exhaustive, are not limiting, are provided in the context of describing representative examples and variations, and are among others supported by various embodiments of the disclosure. Accordingly, those of ordinary skill in the art having benefit of this disclosure will appreciate that the disclosure is not constrained by any such lists, examples, or alternatives. Moreover, the inclusion of lists, examples, embodiments, and the like (where provided as deemed beneficial to readers) may help guide those of ordinary skill in practicing many more implementations and instances that embody the technology without undue experimentation, all of which are intended to be within the scope of the claims.

This disclosure includes figures and discussion in which features and elements of certain embodiments may be organized into what might be characterized as functional blocks, units, subsystems, or modules. And, certain processes and methods may be organized into blocks or into steps. Such organization is intended to enhance readership and to facilitate teaching readers about working principles of the technology and about making and using an abundance of embodiments of the disclosure. The organization is not intended to force any rigid divisions or partitions that would limit the disclosure. In practice, the flexibility of the technology and the depth of this disclosure supports dispersing or grouping functionalities, elements, and features in many different ways. The inclusion of an element or function in one block, unit, module, or subsystem verses another may be substantially arbitrary in many instances, with the divisions being soft and readily redrawn using the teaching provided herein in combination with ordinary skill. Accordingly, functional blocks, modules, subsystems, units, and the like can be combined, divided, repartitioned, redrawn, moved, reorganized, or otherwise altered without deviating from the scope and spirit of the disclosure. This is not to say that, nor will it support a conclusion that, any disclosed organizations and combinations are not novel, are not inventive, or are obvious.

Certain steps in the processes and methods disclosed or taught herein, may naturally need to precede others to achieve desirable functionality. However, the disclosure is not limited to the order of the described steps if such order or sequence does not adversely alter functionality to the extent of rendering the technology inoperable or nonsensical. That is, it is recognized that some steps of a process or method may be performed before or after other steps or in parallel with other steps without departing from the scope and spirit of the disclosure.

In some instances, a process or method (for example that entails using, making, or practicing) may be discussed with reference to a particular illustrated embodiment, application, or environment. For instance, a flowchart may reference or be discussed with reference to a figure. Those of skill in the art will appreciate that any such references are by example and are provided without limitation. Accordingly, the disclosed processes and methods can be practiced with other appropriate embodiments supported by the present disclosure and in other appropriate applications and environments. Moreover, one of ordinary skill in the art having benefit of this disclosure will be able to practice many variations of the disclosed and flowcharted methods and processes as may be appropriate for various applications and embodiments.

The term "couple," as may be used herein, generally refers to joining, connecting, or associating something with something else.

As one of ordinary skill in the art will appreciate, the term "operably coupled," as may be used herein, encompasses direct coupling and indirect coupling via another, intervening component, element, or module; moreover, a first component may be operably coupled to a second component when the first component comprises the second component.

As one of ordinary skill in the art will appreciate, each of the terms "approximate" and "approximately," as may be used herein, provides an industry-accepted tolerance for the corresponding term it modifies. Similarly, the terms "substantial" and "substantially," as may be used herein, provide an industry-accepted tolerance for the corresponding term modified. Such industry-accepted tolerances range from less than one percent to ten percent and correspond to, but are not limited to, component values, process variations, and manufacturing tolerance.

As will be appreciated by those of skill in the art, unless clearly specified otherwise, the values provided herein are intended to reflect commercial design practices or nominal manufacturing targets. For example, what may be described or specified as having a thickness of one millimeter or 1.0 mm, may deviate from one millimeter or 1.0 mm when implemented in a commercial product due to fabrication error, warpage, or customary tolerances.

Turning to the drawings, FIGS. 1, 2, 3, 4, 5, and 6 describe representative features of some example systems for heating skincare fluid and for dispensing heated skincare fluid. Some example embodiments in which the skincare fluid comprises shaving fluid will be further discussed below. One of ordinary skill in the art who has benefit of the disclosure provided herein will be able, without undue experimentation, to make, use, and practice embodiments in which the skincare fluid comprises something other than shaving fluid, including, without limitation, each embodiment of skincare fluid disclosed herein.

Referring now to FIG. 1, this figure illustrates an example handheld system for heating and dispensing shaving fluid according to some embodiments of the disclosure. FIG. 1A illustrates an isometric view of the handheld system. FIG. 1B illustrates an oblique view showing a side of the handheld system that outputs heated shaving fluid. FIG. 1C illustrates another oblique view of the handheld system taken orthogonal to the view of FIG. 1B, wherein heated shaving fluid emits to the left, i.e., left from a reader's perspective.

In the illustrated example embodiment of FIG. 1, the handheld system 100 for heating and dispensing shaving fluid comprises a pressurized vessel 110 containing shaving fluid and a cap 105. As illustrated, the cap 105 and the pressurized vessel 110 are cylindrical in form with like diameters. In some example embodiments, the pressurized vessel 110 can comprise an aerosol can of shaving cream, such as is commercially available at various grocery stores and retail outlets, but with its conventional cap (not illustrated) pried off and discarded. In the illustrated example handheld system 100, the conventional cap, which lacks a heating capability, has been replaced with the cap 105. In the illustrated example of FIG. 1, the cap 105 has like dimensions and like geometry to the discarded, conventional cap. In some example embodiments, an aerosol can of shaving cream can be manufactured and supplied without a cap, and a consumer or other user can attach the cap 105 to the aerosol can to form the handheld system 100 for heating and dispensing shaving fluid that FIG. 1 illustrates.

In the illustrated example of FIG. 1, the cap 105 comprises an upper portion 105A and a lower portion 105B. The lower portion 105B is positionally fixed to the pressurized vessel 110 containing shaving fluid. The upper portion 105A can piston vertically, along an axis (not illustrated) of the pressurized vessel 110, relative to the pressurized vessel 110 and relative to the lower portion 105B. The lower portion 105B captures the upper portion 105A within a cavity 295 (illustrated by FIG. 2) and limits vertical travel or displacement of the upper portion 105.

A user can manually press down on the upper portion 105A of the cap 105 to initiate dispensing of heated shaving fluid. As further discussed below, in operation, when the user manually depresses the upper portion 105A, the cap 105 receives unheated shaving fluid from the pressurized vessel 110, heats the received shaving fluid, and outputs the resulting heated shaving fluid from an outlet 120.

The illustrated combination of the cap 105 and the pressurized vessel 110, upon which the cap 105 is seated, represents one embodiment of a handheld system for heating and dispensing shaving fluid. The cap 105 alone represents another embodiment of a handheld system for heating and dispensing shaving fluid. Accordingly, some example embodiments of a handheld system for heating and dispensing shaving fluid can comprise the cap 105 with or without the pressurized vessel 110.

Figure 2:
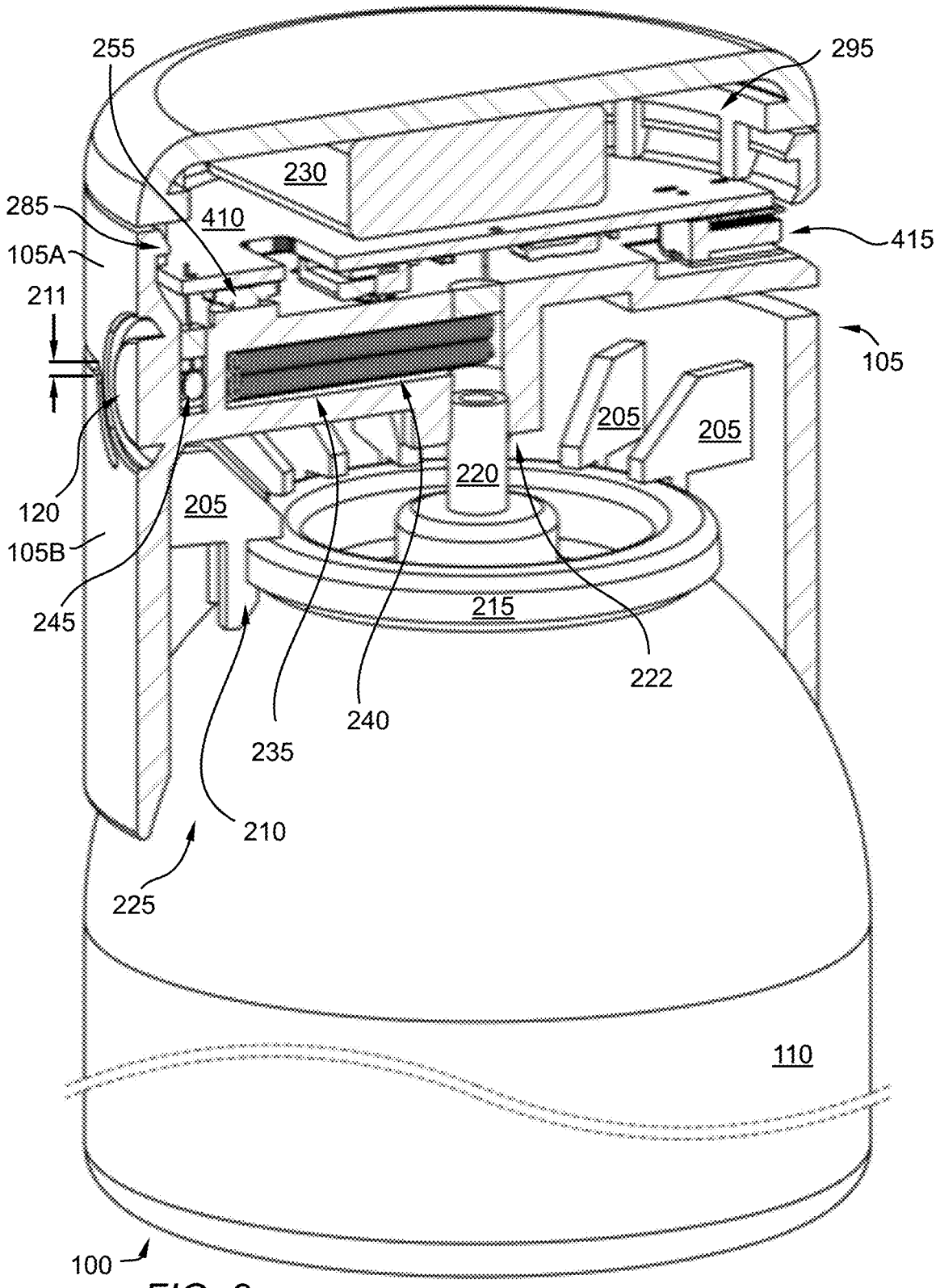
FIG. 2 is an illustration of a handheld system for heating and dispensing shaving fluid, wherein a portion of the handheld system is sectioned to provide a cross sectional view in accordance with some example embodiments of the disclosure.
Figure 3A:
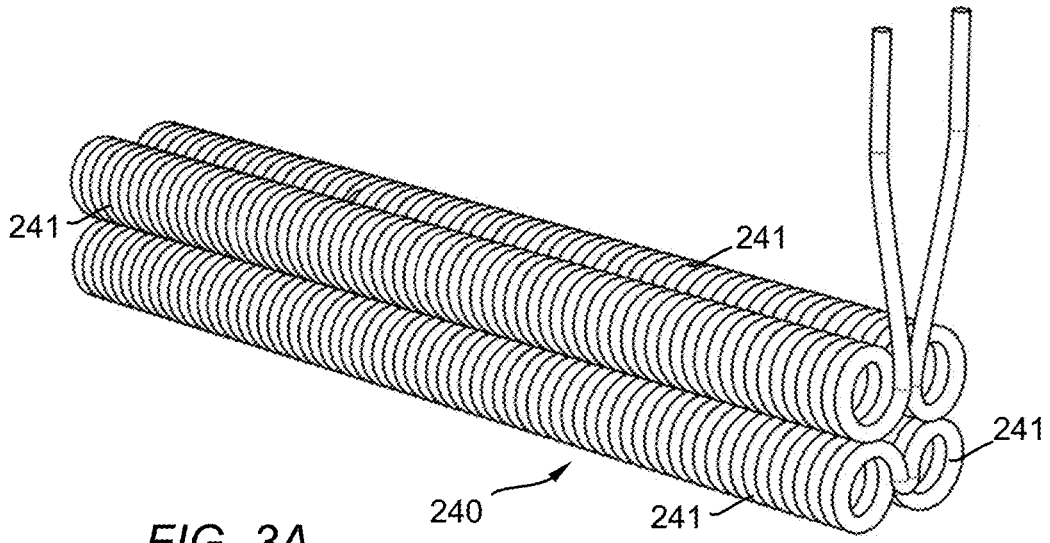
FIGS. 3A and 3B (collectively FIG. 3) are perspective illustrations of a heating coil of a handheld system for heating and dispensing shaving fluid in accordance with some example embodiments of the disclosure.
Figure 3B:
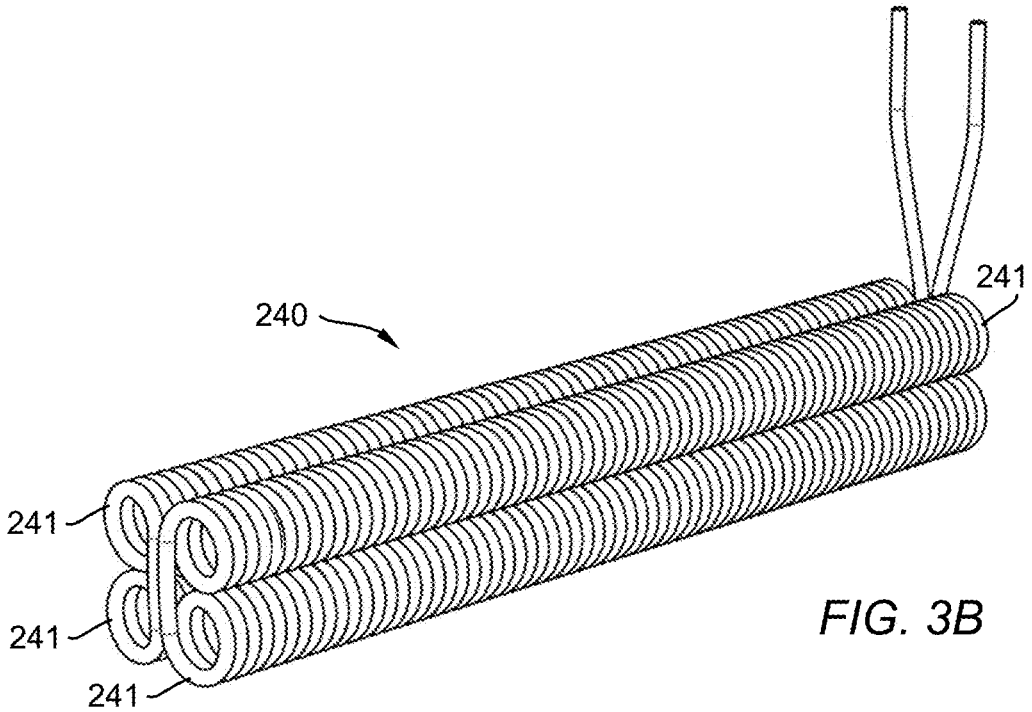
Figure 4A:
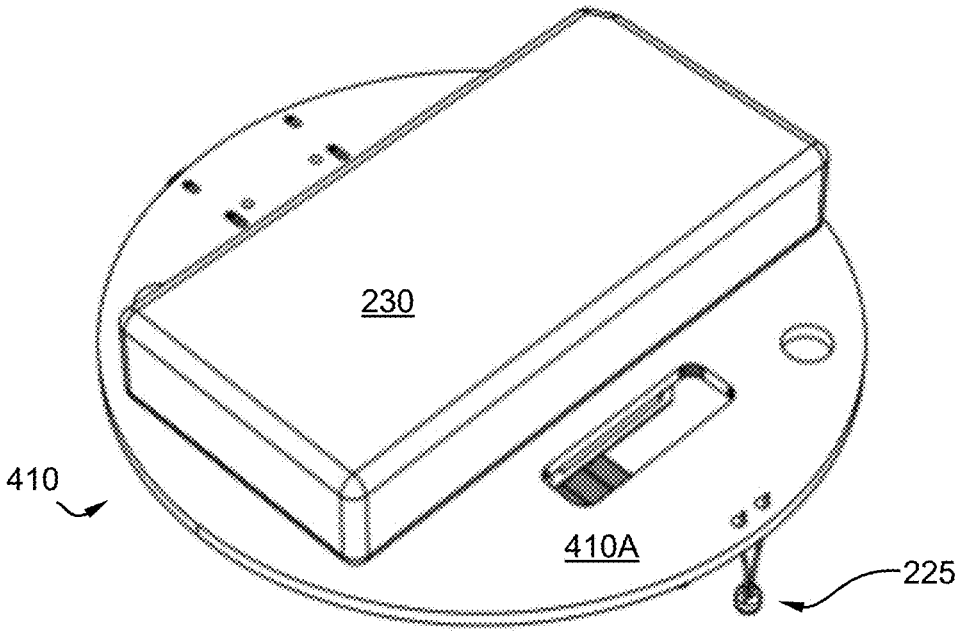
FIGS. 4A and 4B (collectively FIG. 4) are perspective illustrations of upper and lower sides of a circuit board of a handheld system for heating and dispensing shaving fluid in accordance with some example embodiments of the disclosure.
Figure 4B:
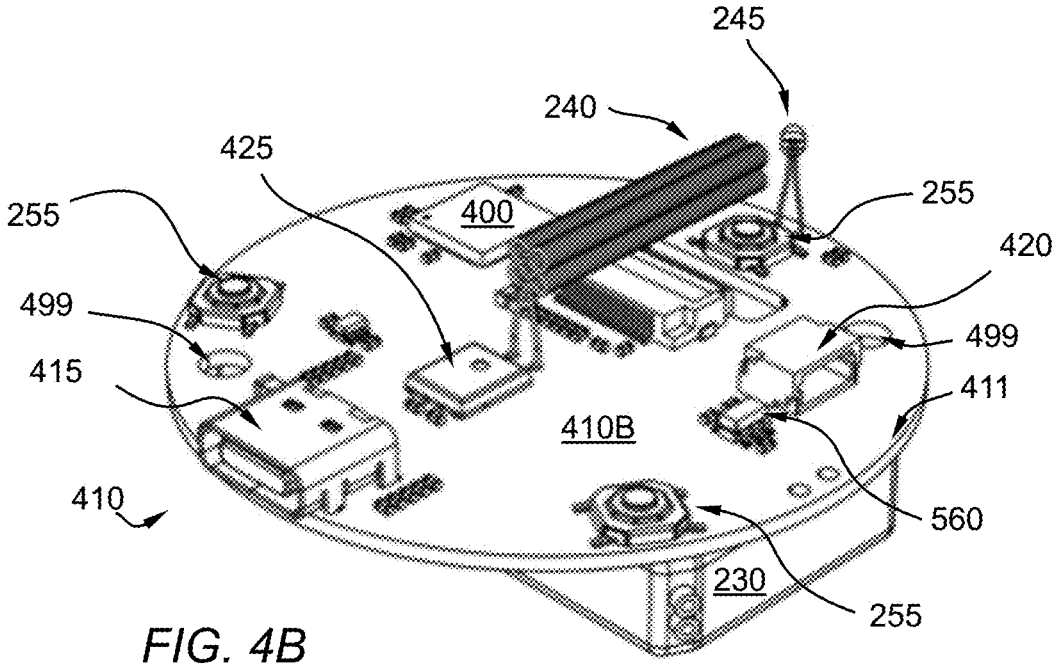
Figure 5:
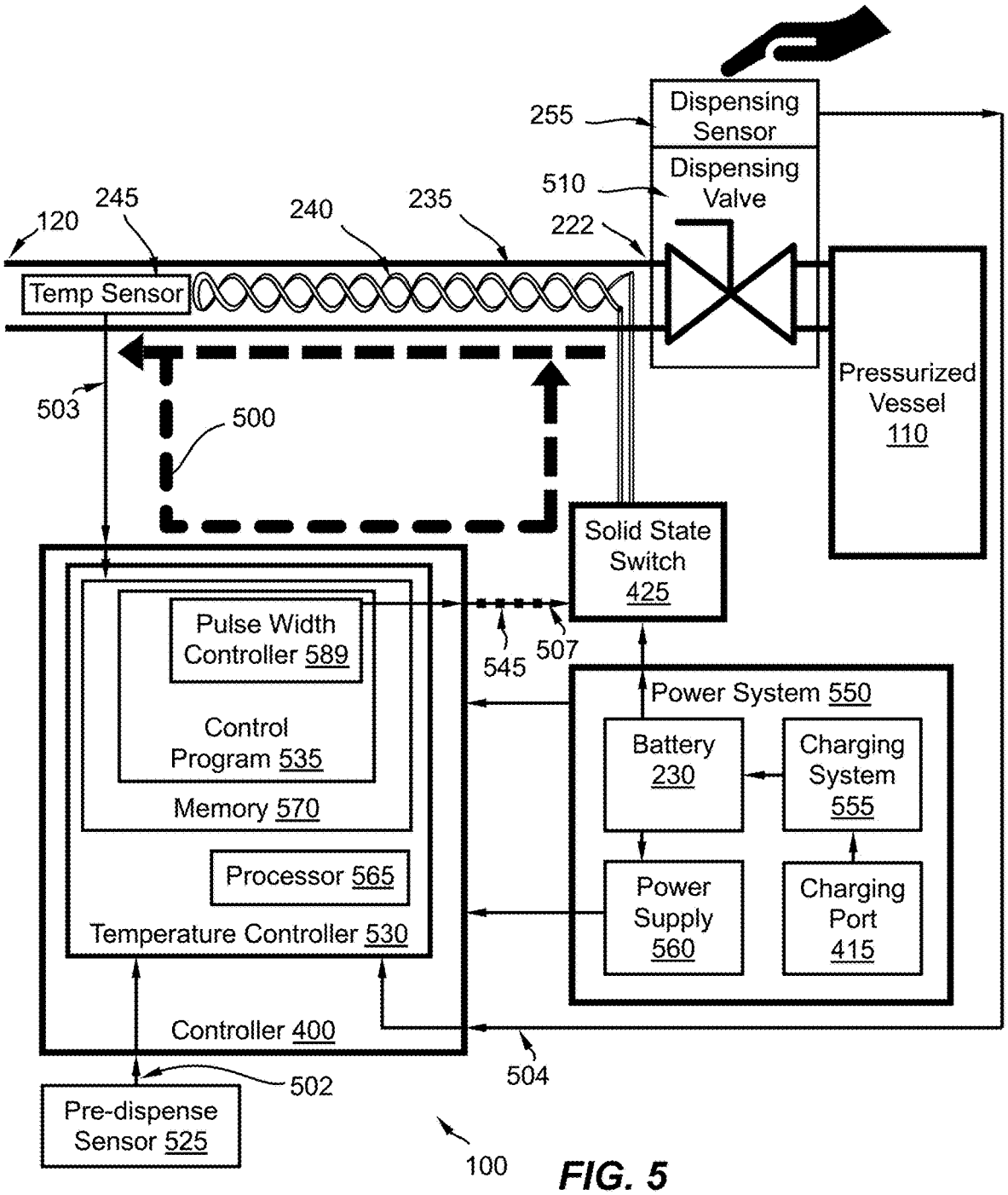
FIG. 5 is a functional block diagram of a handheld system for heating and dispensing shaving fluid in accordance with some example embodiments of the disclosure.

Some example embodiments will now be further discussed with reference to FIGS. 2, 3, 4, and 5. FIG. 2 illustrates the example handheld system 100 for heating and dispensing shaving fluid with the example cap 105 sectioned to show example internal features according to some embodiments of the disclosure. FIG. 3 illustrates an example heating coil 240 that the example cap 105 comprises according to some embodiments of the disclosure. FIG. 4 illustrates example upper and lower sides 410A, 410B of an example circuit board 410 that the example cap 105 comprises according to some embodiments of the disclosure. FIG. 5 illustrates an example functional block diagram of the example handheld system 100 for heating and dispensing shaving fluid according to some embodiments of the disclosure.

As illustrated, the cap 105 is watertight with respect to electrical circuitry (discussed below) that the cap 105 comprises or houses. Accordingly, the handheld system is sufficiently waterproof that the user can operate the illustrated handheld system 100 to dispense heated shaving fluid while taking a shower or taking a bath in a bathtub. In some example embodiments, the upper portion 105A of the cap 105 comprises a watertight housing or enclosure that encloses the electrical circuity. In some example embodiments, the cap 105 comprises a conformal coating or encapsulation that coats or encapsulates the electrical circuitry and protects the electrical circuitry from water.

As illustrated, the cap 105 comprises a battery 230 mounted to the upper side 410A of the circuit board 410. The circuit board 410 is attached to and disposed within the upper portion 105A of the cap 105. Thus, the circuit board 410 (and components mounted thereto) move with the upper portion 105A of the cap 105 when the user depresses the upper portion 105A of the cap 105 to initiate delivery of heated shaving fluid. The lower portion 105B of the cap 105 comprises an inwardly projecting shoulder 285 that can capture the circuit board 410 within the cavity 295. The inwardly projecting shoulder 285 can prevent inadvertent removal of the upper portion 105A from the lower portion 105B. Separation between the upper portion 105A and the lower portion 105B of the cap 105 forms a gap 211. The gap 211, in cooperation with the inwardly projecting shoulder 285, provides for a limited amount of relative vertical travel of the upper portion 105A of the cap 105. The vertical travel facilitates the user depressing the upper portion 105A of the cap to dispense heated shaving fluid.

As illustrated by FIG. 4, the circuit board 410 comprises two apertures 499 for aligning the circuit board 410 during assembly of the cap 105. A connector 420 provides an interface for connecting a developmental cable (not illustrated) for testing and programming of the cap 105.

In the illustrated example, the battery 230 is rechargeable via a watertight charging port 415 disposed on a vertically oriented cylindrical side of the cap 105 opposite the outlet 120. In some example embodiments, the watertight charging port 415 comprises a waterproof USB-C connector. In some example embodiments, the battery 230 comprises a capacity of 1 amp-hour, a 5 C discharge rate, and a nominal voltage of 7 volts. (Other example embodiments may comprise batteries having other battery specifications.) In some example embodiments, the battery 230 is rechargeable and comprises one or more lithium-ion (Li-ion) cells. In some example embodiments, the battery 230 is rechargeable and comprises one or more nickel-cadmium (NiCd) cells. In some example embodiments, the battery 230 is rechargeable and comprises one or more nickel-metal hydride (NiMH) cells.

In the illustrated example, an electrical path 501 extends between the battery 230 and the watertight charging port 415. As illustrated in FIG. 5, a charging system 555 manages battery recharging. The battery 230, the watertight charging port 415, and the charging system 555 are example features of a power system 550. The power system 550 further comprises a power supply 560 that converts voltage of the battery 230 into voltage levels used by various electrical components as illustrated and discussed below.

In some example embodiments, the battery 230 comprises a single-use battery, such as an alkaline battery comprising one or more cells, without an accompanying charging system 555 or charging port 415. In some such embodiments, the battery 230 can have an energy capacity selected to heat the shaving fluid of a single pressurized vessel 110 containing shaving fluid. Accordingly, in some single-use embodiments, an energy capacity of the battery 230 and an amount of shaving fluid in the pressurized vessel 110 can be selected so they become exhausted synchronously, concurrently, in parallel with one another, or within a specified usage time of one another. In some examples, a single-use embodiment of the battery 230 is configured to become exhausted when less than approximately fifteen percent of the original shaving fluid remains in the pressurized vessel 110. In some examples, a single-use embodiment of the battery 230 is configured to be exhausted when less than approximately fifteen percent of the original pressure remains in the pressurized vessel 110.

As can be seen in FIG. 2, the illustrated example embodiment of the cap 105 comprises a receptacle 225 disposed at a bottom side of the lower portion 105B of the cap 105. The pressurized vessel 110 containing shaving fluid releasably plugs into the receptacle 225. In some example embodiments, the receptacle 225 comprises integral features of a housing of the cap 105 that is formed by injection-molding a polymer, such as polypropylene, polymethyl methacrylate, nylon, or acetal (not an exhaustive list). The illustrated example receptacle 225 comprises a releasable catch 205 configured to releasably engage a protruding rim 215 of the pressurized vessel 110 containing shaving fluid. In the illustrated example, the releasable catch 205 comprises an array of releasable catches 205 that are arranged in a circular pattern and configured to snap onto the protruding rim 215. Each releasable catch 205 comprises a respective notched protrusion 210 dimensioned to receive and engage the protruding rim 215.

When the user exhausts one pressurized vessel 110 containing shaving fluid, the releasable catch 205 can facilitate the user removing the cap 105 from the exhausted vessel and attaching the cap 105 to a new pressurized vessel 110 containing shaving fluid. Thus, the illustrated example cap 105 snaps onto and off of pressurized vessels 110 of shaving fluid. Accordingly, via the illustrated receptacle 225 that comprises the resealable catch 205, some embodiments of the cap 105 can be compatible with commercially available aerosol cans of shaving cream.

In some other example embodiments, the cap 105 can be configured to be permanently attached to a single aerosol can of shaving fluid. For instance, an embodiment of the cap 105 that incorporates a non-rechargeable battery can be permanently attached to an aerosol can of shaving cream to form a single-use unit that may be disposable or that may be returnable to a supplier for recycle.

The illustrated pressurized vessel 110 containing shaving fluid comprises a nozzle 220 configured to emit shaving fluid and an associated manually actuated dispensing valve 510. The manually actuated dispensing valve 510 is internal to the pressurized vessel 110 and below the nozzle 220; thus, the manually actuated dispensing valve 510 is not visible in FIG. 2. The functional block diagram of FIG. 5 illustrates the manually actuated dispensing valve 510 as a functional block. For compatibility with commercially available aerosol cans of shaving cream, a threshold amount of depression of the upper portion 105A of the cap 105 can transfer to the nozzle 220 to actuate the manually actuated dispensing valve 510 to open the valve 510, causing shaving fluid and emit through the nozzle 220.

The cap 105 comprises an inlet 222 that is centrally disposed in the receptacle 225 and is dimensioned to mate with the nozzle 220. In some example embodiments, the nozzle 220 and the inlet 222 have mating tapers. The inlet 222 receives shaving fluid emitted through the nozzle 220. The cap 105 further comprises a channel 235 that extends from the inlet 222 to the outlet 120 and comprises a turn from vertical to horizontal that can comprise a perpendicular turn. As illustrated, the inlet 222 comprises an inlet of the channel 235, and the outlet 120 comprises an outlet of the channel 235. In operation, shaving fluid flows through the channel 235 when the user actuates the manually actuated dispensing valve 510 by depressing the upper portion 105A of the cap 105 (and thereby depressing the nozzle 220 and opening the dispensing valve 510).

In some example embodiments, the gap 211 has a selected dimension (i.e. a selected amount of vertical separation between the upper and lower portions 105A, 105B of the cap 105) that correlates with a threshold amount of depression of the nozzle 220 for opening the manually actuated dispensing valve 510. In some example embodiments, the gap 211 comprises a first distance of vertical separation between the upper and lower portions 105A, 105B of the cap 105 that defines maximum vertical travel distance of the upper portion 105A of the cap 105; a second distance defines an amount of vertical depression of the nozzle 220 that opens the manually actuated dispensing valve 510; and the first distance is no less than the second distance. In some example embodiments, the first distance is greater than the second distance and less than 1.33 times the second distance.

As illustrated, a heating coil 240 is mounted to the lower side 410B of the circuit board 410. The illustrated heating coil 240 comprises an example embodiment of a heating element. The heating coil 240 is disposed in the channel 235 in the illustrated example configuration. As illustrated, the heating coil 240 is disposed in a portion of the channel 235 that is below the circuit board 410 and that extends lengthwise along the lower side 410B of the circuit board 410. In the illustrated example, the heating coil 240 comprises four heating coil segments 241 (i.e., segments of heating coil) that extend lengthwise alongside one another in the channel 235. As viewed in cross section, the four heating coil segments 241 are arranged in a cloverleaf pattern, i.e., in a geometry resembling a four-leaf clover. The four heating coil segments 241 are connected together in electrical series. In some example embodiments, each of the four heating coil segments 241 comprises 70 loops of copper wire having a diameter of 0.25 mm. Some other embodiments can comprise different coil arrangements or different heating elements. In operation, shaving fluid flows through and around the heating coil segments 241 as the shaving fluid moves through the channel 235 and is heated by the heating coil 240. Accordingly, in some example embodiments, shaving fluid deliberately contacts the heating coil 240 in the channel 235 while the heating coil 240 heats the shaving fluid. In some example embodiments, the heating coil 240 heats the shaving fluid in the channel to achieve a target or setpoint temperature of 150 degrees Fahrenheit (approximately 65.5 degrees Celsius) of shaving fluid output from the channel through the outlet 120. Other embodiments may heat to higher or lower targets temperatures of dispensed shaving fluid.

In the illustrated example, a temperature sensor 245 is mounted to the lower side 410B of the circuit board 410 and is disposed in the channel 235. In the illustrated example, the temperature sensor 245 is disposed downstream from the heating coil 240. In the illustrated example, the temperature sensor 245 is disposed adjacent the outlet 120. Accordingly, in some example embodiments, shaving fluid deliberately contacts the temperature sensor 245 as the shaving fluid flows through the channel 235 and the heating coil 240 heats the shaving fluid. In some example embodiments, the temperature sensor 245 comprises a thermistor, a negative temperature coefficient (NTC) thermistor, a resistance temperature detector (RTD), a thermocouple, or other appropriate means for sensing temperature.

In the illustrated example, the cap 105 comprises a dispensing sensor 255 that is operative to sense manual actuation of the manually actuated dispensing valve 510. As illustrated by FIG. 4B, an example embodiment of the dispensing sensor 255 comprises three microswitches 255 mounted to the lower side 410B of the circuit board 410 adjacent a periphery 411 or outer edge of the circuit board 410. In the illustrated example embodiment, the three microswitches 255 are spaced about the periphery 411 of the circuit board 410 in a triangular geometry. Thus, the three microswitches 255 are arranged to form three respective vertices of a triangle (not illustrated), wherein a vertical axis (not illustrated) of the nozzle 220 and the pressurized vessel 110 extends centrally through the triangle. When the user depresses the upper portion 105A of the cap 105 to open the manually actuated dispensing valve 510, the temperature sensor 245 notifies a temperature controller 530 by sending a dispensing signal over one or more input/output lines 504.

In the example embodiment that FIG. 5 illustrates, the cap 105 comprises a controller 400 that can comprise a microcontroller. In some example embodiments, the microcontroller can comprise an embedded controller or a microcontroller unit (MCU). In some example embodiments, the controller comprises memory 570, a processor 565, and input/output on a single chip or in an integrated package or format. In some example embodiments, the processor 565 can comprise a microprocessor. In the embodiment that FIG. 4B illustrates, the controller 400 comprises a chip mounted to the lower side 410B of the circuit board 410.

As illustrated by FIG. 5, the controller 400 comprises the temperature controller 530 with a control program 535 stored in the memory 570. For example, the memory can comprise non-transitory memory or non-volatile memory that stores instructions of the control program 535. As further discussed below with reference to FIG. 6, some example embodiments of the control program 535 can define or set forth a process or method (or steps thereof) for controlling the heating coil 240 to heat shaving fluid to dispense shaving fluid comprising a target or setpoint temperature. The processor 565 can execute the control program 535, and the cap 105 can perform the process or method or steps thereof.

As illustrated by example FIG. 5, the temperature controller 530 receives a temperature signal from the temperature sensor 245 via one or more input/output lines 503. As further illustrated by example FIG. 5 and discussed above, the temperature controller 530 receives the dispensing signal from the dispensing sensor 255 via one or more input/output lines 504.

In the illustrated example embodiment of FIG. 5, the cap 105 comprises a pre-dispense sensor 525. The pre-dispense sensor 525 can predict or anticipate actuation of the manually actuated dispensing valve 510, which the dispensing sensor 255 senses as discussed above. In some example embodiments, the pre-dispensing sensor 525 senses that the user will initiate dispensing of heated shaving fluid and that such initiation is imminent, approaching, forthcoming, anticipated, or otherwise predicted to occur at a future time. In some example embodiments, the future time can comprise a specified time, for instance at 7:30 am every weekday. In some example embodiments, the future time can comprise a future time period, for instance during the next five seconds. The cap 105 can thus predict that the user is about to initiate dispensing of shaving fluid.

In some example embodiments, the pre-dispense sensor 525 sends a sensing signal to the temperature controller 530 via one or more input/output lines 502 as illustrated by FIG. 5. In some example embodiments, the pre-dispense sensor 525 is integrated into the controller 400, for instance as an accelerometer that is integrated into a single chip or disposed within an integrated package or format.

As further discussed below, including with reference to FIG. 6, the temperature controller 530 can commence heating of the heating coil 240 in response to receiving a pre-dispense signal from the pre-dispense sensor 525, thereby expediting dispensing of heated shaving fluid when the user initiates dispensing of heated shaving fluid.

In some example embodiments, the pre-dispense sensor 525 comprises a predictor. The term "predictor," as used herein, generally refers to something that predicts or anticipates an occurrence of an event prior to the event occurring.

In some example embodiments, the pre-dispense sensor 525 comprises a predictor that comprises an accelerometer. The accelerometer can sense motion of the cap 105 associated with the user picking up the handheld system 100 in preparation for dispensing heated shaving fluid. Responsive to sensing motion, the accelerometer can provide the temperature controller 530 a signal indicative of pre-dispensing. Responsive to that signal, the temperature controller 530 can initiate heating in advance of the user initiating dispensing of heated shaving fluid by the user manually actuating the manually actuated dispensing valve 510.

In some example embodiments, the pre-dispense sensor 525 comprises a predictor that comprises a capacitive sensor. The capacitive sensor can sense the user's hand approaching the handheld system 100 in preparation for dispensing heated shaving fluid. Responsive to sensing this condition, the capacitive sensor can provide the temperature controller 530 a signal indicative of pre-dispensing. Responsive to that signal, the temperature controller 530 can initiate heating in advance of the user initiating dispensing of heated shaving fluid by the user manually actuating the manually actuated dispensing valve 510.

In some example embodiments, the pre-dispense sensor 525 comprises a predictor that comprises a photodetector. The photodetector can sense the user turning on a light, such as a bathroom light, in preparation for dispensing heated shaving fluid. Responsive to sensing this condition, the photodetector can provide the temperature controller 530 a signal indicative of pre-dispensing. Responsive to that signal, the temperature controller 530 can initiate heating in advance of the user initiating dispensing of heated shaving fluid by the user manually actuating the manually actuated dispensing valve 510.

In some example embodiments, the pre-dispense sensor 525 comprises a predictor that comprises a microphone. The microphone can sense noise or a voice command of the user associated with the user preparing to dispense heated shaving fluid. Responsive to sensing this condition, the photodetector can provide the temperature controller 530 a signal indicative of pre-dispensing. Responsive to that signal, the temperature controller 530 can initiate heating in advance of the user initiating dispensing of heated shaving fluid by the user manually actuating the manually actuated dispensing valve 510.

In some example embodiments, the pre-dispense sensor 525 comprises a predictor that comprises a user-depressible button or switch. The user can press the user-depressible button or flip the switch to notify the handheld system 100 that that the user intends to initiate dispensing heated shaving fluid. Responsive to sensing pressing of the button or flipping the switch, the temperature controller 530 can determine a pre-dispensing condition and can initiate heating in advance of the user initiating dispensing of heated shaving fluid by the user manually actuating the manually actuated dispensing valve 510.

In some example embodiments, the pre-dispense sensor 525 comprises a predictor that comprises an antenna. Via the antenna, the temperature controller 530 can receive a wireless signal from the user notifying that the user intends to initiate dispensing heated shaving fluid. For instance, the user can send the signal via a smart phone or other appropriate device of the user that communicates wirelessly. Responsive to receipt of the wireless signal, the temperature controller 530 can determine a pre-dispensing condition and can initiate heating in advance of the user initiating dispensing of heated shaving fluid by the user manually actuating the manually actuated dispensing valve 510.

In some example embodiments, the pre-dispense sensor 525 comprises a predictor that comprises a clock or a timer and a user interface. In some embodiments, the user interface can be a physical part of the cap 105 or a remote interface on a smartphone that wirelessly connects to the cap 105. Via the user interface, the user can enter a time that the user intends to initiate dispensing heated shaving fluid. At the entered time, the temperature controller 530 can determine a pre-dispensing condition and can initiate heating in advance of the user initiating dispensing of heated shaving fluid by the user manually actuating the manually actuated dispensing valve 510.

As illustrated in FIG. 5, in some example embodiments, the temperature controller 530 is configured to issue or output a temperature control signal 545 to a solid state switch 425 via one or more input/output lines 507. In some example embodiments, the solid state switch 425 comprises a metal-oxide-semiconductor field-effect transistor (MOSFET). In the embodiment that FIG. 4 illustrates, the solid state switch 425 is mounted to the lower side 410B of the circuit board 410. The solid state switch 425 controls electricity supplied from the battery 230 to the heating coil 240 for temperature control. In some example embodiments, the solid state switch 425, when in a conducting state, supplies electricity directly from the battery 230 to the heating coil 240. That is, electricity can flow from the battery 230, through the solid state switch 425, and to the heating coil 240 without flowing through any component that, under normal operating conditions, purposely attenuates voltage or current of said electricity. In some example embodiments, when the solid state switch 425 is in the conducting state, voltage drop between the battery 230 and the heating coil not is more than one-third of a volt.

In some example embodiments, the cap 105 comprises a pulse width modulator in which the temperature controller 530 and the solid state switch 425 collaboratively utilize pulse width modulation (PWM) to control temperature. In some example embodiments, the control program 535 can comprise a pulse width controller (PWC) 589 that supports producing the temperature control signal 545. The pulse width modulator can comprise the solid state switch 425 and the pulse width controller 589 in some example embodiments. Further, the temperature controller 530 and the solid state switch 425 can comprise the pulse width modulator.

Some example embodiments of the temperature control signal 545 can set a duty cycle defining a fraction of time that the solid state switch 425 provides electricity to the heating coil 240. For example, when the temperature controller 530 sets the duty cycle to twenty five percent, the solid state switch 425 can provide flow of electricity from the battery 230 to the heating coil 240 for twenty five percent of available time, for instance by providing electrical pulses having a width (i.e., of a time duration) that is twenty five percent of a full/maximum width. Similarly, when the temperature controller 530 sets the duty cycle to one hundred percent, the solid state switch 425 can provide flow of electricity from the battery 230 to the heating coil 240 for one hundred percent of available time, for instance by providing electrical pulses having a width that is one hundred percent of a full/maximum width. And when the temperature controller 530 sets the duty cycle to zero percent, the solid state switch 425 can ongoingly block electricity from flowing to the heating coil 240, which may be viewed as providing pulses having zero width.

Accordingly, the solid state switch 425 can be configured to control the heating coil 240 according to the control signal 545 by modulating width of pulses of electricity flowing from the battery 230 to the heating coil 240.

As illustrated by FIG. 5, the example handheld system can comprise a feedback control loop 500 that controls the temperature of dispensed shaving fluid utilizing the temperature sensor 245 for feedback. The feedback control loop 500 can comprise a digital controller that the control program 535 comprises. For example, the feedback control loop 500 can comprise a code-based proportional-integral-derivative (PID) controller as an example embodiment of a digital controller.

Some example methods and processes for heating and dispensing shaving fluid be further discussed below. In some example embodiments, the controller 400 comprises non-transitory memory 570 and instructions stored thereon, that when executed by the controller, perform a method or cause the cap 105 or the handheld system 100 to perform a method. In some example embodiments, the method comprises controlling the heating coil 240 by varying the control signal 545 according to a temperature signal provided by the temperature sensor 245, according to a dispensing signal provided by the dispensing sensor 255, and according to an accelerometer signal provided by an embodiment of the pre-dispensing sensing 525 that comprises an accelerometer.

In some example embodiments, the method comprises: predicting or anticipating when the user will actuate the manually actuated dispensing valve 510; and initiating heating of the heating coil 240 in advance of the user actuating the dispensing valve 510. In some example embodiments, the method is performed by the controller 400 and comprises: in advance of the user initiating dispensing of heated shaving fluid, predicting whether the user is about to initiate dispensing of heated shaving fluid; and responsive to a prediction that the user is about to initiate dispensing of heated shaving fluid, heating the heating coil 240 in advance of the user initiating dispensing of heated shaving fluid.

Advance heating of the heating coil 240 can heat shaving fluid that resides in the channel 235 from prior dispensing, such as from dispensing moments earlier, or from a previous usage of the handheld system 100, such as residue from an earlier shave that may have occurred hours or a day earlier. Moreover, advance heating of the heating coil 240 can shorten or eliminate lag or response time associated with heating the heating coil 240, with heating sidewalls of the channel 235, and with heating materials of the cap 105 that adjoin the channel 235. That is, advance heating of the heating coil 240 can avoid time delay associated with raising temperature of the heating coil 240 and adjacent materials of the cap 105 from ambient temperature to an elevated target temperature. Accordingly, when the user actuates the manually actuated dispensing valve 510, heat can rapidly transfer to the shaving fluid, and the handheld system 100 can dispense heated shaving fluid promptly or without user-perceptible delay. In some example embodiments, the first shaving fluid that the outlet 120 outputs in response to the user actuating the manually actuated dispensing valve 510 is heated to a desired or target level according to a setpoint. In some example embodiments, responsive to the user actuating the manually actuated dispensing valve 510, the handheld system 100 outputs a stream of heated shaving fluid of sufficient quantity for shaving, wherein an initial or leading portion of the stream is heated to a desired or target level according to a setpoint. In some example embodiments, that initial or leading portion of the stream has a first Celsius temperature, and an ending or trailing portion of the stream has a second Celsius temperature that is within ten percent of the first Celsius temperature. In some example embodiments, any temperature variation along the stream is at a level that is imperceptible to the user as the stream is received in a palm of the user's hand. Accordingly, in some example embodiments, the method can comprise managing or reducing deadtime, time lag, or time delay between the user initiating dispensing of heated shaving fluid and the user receiving heated shaving fluid.

Figure 6:
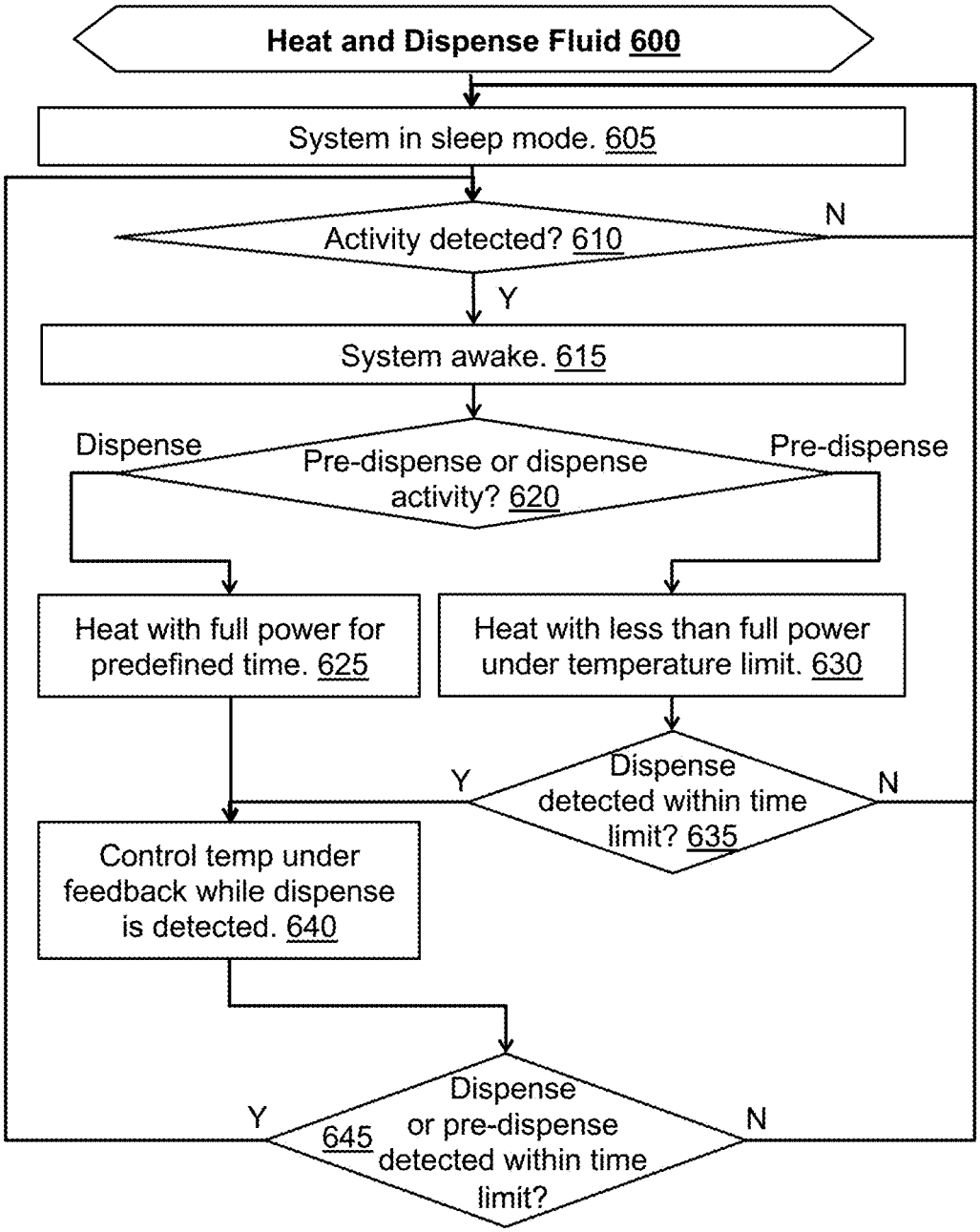
FIG. 6 is flowchart of a method or process for heating and dispensing shaving fluid in accordance with some example embodiments of the disclosure.

Turning now to FIG. 6, this figure illustrates an example flowchart of an example method 600 for heating and dispensing shaving fluid according to some embodiments of the disclosure. In example embodiments, the method 600 can be viewed as a process.

At block 605 of the method 600, the handheld system 605 is in a sleep mode. In some example embodiments of the sleep mode, the temperature controller 530 monitors for input from the dispensing sensor 255 and the pre-dispense sensor 525, while the heating coil 240 is remains in an unenergized mode, without receiving heating electricity from the battery 230.

The method 600 proceeds from block 605 to decision block 610. At decision block 610, the temperature controller 530 determines if activity has been detected. If the temperature controller 530 determines that a dispensing signal from the dispensing sensor 255 or a pre-dispense signal from the pre-dispense sensor 525 has not been received, then the method 600 loops from block 610 back to block 605, and the handheld system remains in the sleep mode. On the other hand, if the temperature controller 530 receives a dispensing signal from the dispensing sensor 255 or a pre-dispense signal from the pre-dispense sensor 525, then the method 600 executes block 615 and the handheld system 100 wakes, thereby changing from the sleep mode to a wake mode.

Execution of decision block 620 follows block 615 in the flowcharted example method 600 of FIG. 6. At decision block 620, method 600 branches to block 630 if the temperature controller 530 receives a pre-dispense signal from the pre-dispense sensor 525. On the other hand, method 600 branches from decision block 620 to block 625 if the temperature controller 530 receives a dispense signal from the dispensing sensor 255.

At block 625, the temperature controller 530 heats the temperature controller 530 with full power for a specified amount of time. In some example embodiments, the temperature controller 530 issues a control signal 545 that causes the solid state switch 425 to operate at a one hundred percent pulse width modulation duty cycle as discussed above. Thus, fixed-width pulses of electricity can flow from the battery 230 to the heating coil 240, wherein pulse width is fixed to one hundred percent of full/maximum pulse width. A configurable number stored in the memory 570 can define the specified period of time, for example 10 seconds or an another appropriate value. Thus, at block 625, the handheld system 100 operates in a mode of heating, in open loop, with full power for a specified period of time.

At block 630, the temperature controller 630 sends a control signal 545 to the solid state switch 425 to heat the heating coil 240 with a specified amount of power while imposing a temperature limit. Thus, the handheld system 100 operates in a mode of heating, in open loop, with less than full power under a temperature limit. In some example embodiments, the control signal 545 causes the solid state switch 425 to operate at a twenty five percent pulse width modulation duty cycle as discussed above. Thus, fixed-width pulses of electricity can flow from the battery 230 to the heating coil 240, wherein pulse width is fixed to twenty five percent of full/maximum pulse width. (Twenty five percent is an example, non-limited value among other supported by this disclosure.) This value, twenty five percent or another appropriate value, can be stored in the memory 570 as a configurable number and retrieved by the temperature controller 630. At block 630, the temperature controller 630 monitors temperature as sensed by the temperature sensor 245 and compares the monitored temperature to the temperature limit. If the temperature controller 630 determines that the monitored temperatures exceeds the temperature limit, then the temperature controller 630 causes the solid state switch 425 to cease supplying electricity to the heating coil, for instance by setting the pulse width modulation duty cycle to zero. In some example embodiments, the temperature limit is a configurable value stored in the memory 570. In some example embodiments, the temperature limit is set to 150 degrees Fahrenheit (approximately 65.5 degrees Celsius), which is an example, non-limited value among other supported by this disclosure.

In the example embodiment of the method 600 that FIG. 6 flowcharts, execution of decision block 635 follows execution of block 630. At decision block 635, the temperature controller 630 determines whether the dispensing sensor 255 has issued a dispense signal within a specified period of time of the temperature controller 630 receiving the pre-dispense signal at decision block 620. A configurable number stored in the memory 570 can define the specified period of time, for example 180 seconds or an another appropriate value. If the determination at decision block 635 is negative, then the method 600 loops back to block 605 and the handheld system 100 returns to sleep mode. If, on the other hand, the temperature controller 630 makes a positive determination at decision block 635, then the method 600 proceeds to block 640, and the temperature controller 630 executes block 640.

In addition to executing block 640 following a positive determination at decision block 635, the method 600 executes block 640 following execution of block 625, which is discussed above. At block 640, the handheld system 100 operates in a mode of closed loop feedback control utilizing the feedback control loop 500 for temperature control. In some example embodiments, operating the handheld system 100 in the closed loop mode comprises modulating width of pulses of electricity flowing from the battery 240 to the heating coil 230 according to a temperature setpoint and feedback provided by the temperature sensor 245. The handheld system 100 operates in the closed loop mode while the temperature controller 530 receives the dispense signal from the dispensing sensor 255, indicating that the user is actuating the manually actuated dispensing valve 510. In some example embodiments, the temperature sensor 245 provides a real-time temperature measurement of dispensed shaving fluid that the control program 535 of the temperature controller 530 uses as feedback. In some example embodiments, the control program 535 comprises the PID controller discussed above. The control program 535 can thus comprise a digital controller or an executable control algorithm. In example operation, the control program 535 manipulates the control signal 545 and thereby adjusts electricity supplied to the heating coil 240 to achieve a target or setpoint temperature of dispensed shaving fluid as measured by the temperature sensor 245. The temperature controller 530 can thus adjust electrical power delivered to the heating coil according to a difference between a setpoint temperature and a measured temperature. Representative adjustments can comprise increasing power if the measured temperature is below the setpoint temperature and decreasing power if the measured temperature is above the setpoint temperature. In some example embodiments, the temperature target or setpoint is a configurable value stored in the memory 570. In some example embodiments, the target or setpoint may be user-defined, for instance entered by the user into a user interface (not illustrated) that the cap 105 comprises or a remote user interface in wireless communication with the cap 105. In some example embodiments, the target or setpoint temperature is set to 150 degrees Fahrenheit (approximately 65.5 degrees Celsius), which is an example, non-limited value among other supported by this disclosure. Once the user releases, or stops depressing, the dispensing valve 510, the temperature controller 530 ceases heating of the heating coil 240, and the method executes decision block 645.

As discussed above, the method 600 proceeds from block 640 to decision block 645 upon the user releasing the manually actuated dispensing valve 510. Decision block 645 determines whether the temperature controller 530 has received a dispense signal or a pre-dispense signal within a specified time limit of the release of the dispensing valve 510. If the determination is negative, then the method 600 loops back to block 605 and the handheld system 100 returns to the sleep mode. If the determination is positive, then the method 600 loops back to decision block 610, and the handheld system 100 executes decision block 610 as discussed above.

Useful technology for heating and dispensing skincare fluids has been described. From the description, it will be appreciated that an embodiment of the disclosure overcomes limitations of the prior art. Those skilled in the art will appreciate that the technology is not limited to any specifically discussed application or implementation and that the embodiments described herein are illustrative and not restrictive. Furthermore, the particular features, structures, or characteristics that are set forth may be combined in any suitable manner in one or more embodiments based on this disclosure and ordinary skill. Those of ordinary skill having benefit of this disclosure can make, use, and practice a range of embodiments via combining the disclosed features and elements in permutations without undue experimentation and further by combining the disclosed features and elements with what is well known in the art. This disclosure not only includes the illustrated and described embodiments, but also provides a roadmap for additional embodiments using the various disclosed technologies, elements, features, their equivalents, and what is well known in the art. From the description of the example embodiments, equivalents of the elements shown herein will suggest themselves to those skilled in the art, and ways of constructing other embodiments will appear to practitioners of the art. Therefore, the scope of the technology is to be limited only by the appended claims.

What is claimed is:

1. A handheld system for heating and dispensing shaving fluid, the handheld system comprising:

a housing comprising:

a lower portion;

an upper portion that comprises a cylindrical surface, that is disposed above the lower portion, and that is vertically oriented;

a gap between the upper portion and the lower portion; and a receptacle disposed at a bottom side of the lower portion of the housing, the receptacle comprising a releasable catch configured to engage a protruding rim of a pressurized vessel containing shaving fluid, wherein the pressurized vessel containing shaving fluid comprises a manually actuated dispensing valve and a nozzle that emits shaving fluid when the manually actuated dispensing valve is manually actuated by depressing the upper portion to reduce the gap;

an inlet that is centrally disposed in the receptacle, dimensioned to mate with the nozzle, and operative to receive shaving fluid emitted by the nozzle;

an outlet disposed on the cylindrical surface of the upper portion of the housing and operative to emit heated shaving fluid;

a channel extending from the inlet to the outlet;

a watertight charging port disposed on the cylindrical surface of the upper portion of the housing;

a circuit board mounted in the upper portion;

a battery mounted to an upper side of the circuit board;

an electrical path extending between the battery and the watertight charging port;

a heating coil mounted to the circuit board, wherein the heating coil is disposed in a portion of the channel that is below the circuit board and that extends along a lower side of the circuit board, wherein the heating coil comprises four heating coil segments that extend lengthwise alongside one another in the channel, and wherein the four heating coil segments are connected in electrical series to one another;

a temperature sensor mounted to the lower side of the circuit board and disposed in the channel downstream from the heating coil adjacent the outlet;

a dispensing sensor that is operative to sense manual actuation of the manually actuated dispensing valve, the dispensing sensor comprising three switches mounted to the lower side of the circuit board adjacent a periphery of the circuit board, wherein the three switches are spaced about the periphery in a triangular geometry;

an accelerometer disposed adjacent the circuit board;

a controller mounted to the lower side of the circuit board and comprising an output configured to output control signals; and a solid state switch mounted to the lower side of the circuit board, wherein the solid state switch is operably coupled to the output of the controller to receive the control signals, to the battery, and to the heating coil, wherein the solid state switch comprises a metal-oxide-semiconductor field-effect transistor, wherein the solid state switch is configured to control the heating coil according to the control signals by modulating width of pulses of electricity flowing from the battery to the heating coil, wherein the handheld system is watertight with respect to electrical circuitry that the handheld system comprises, wherein the controller further comprises non-transitory memory and instructions stored thereon, that when executed by the controller, perform a method, and wherein the method comprises controlling the heating coil by varying the control signals according to a temperature signal provided by the temperature sensor, a dispensing signal provided by the dispensing sensor, and an accelerometer signal provided by the accelerometer.

2. The handheld system of claim 1, wherein the method comprises:

by the controller, monitoring the dispensing sensor and the accelerometer while the handheld system is in a sleep mode;

by the controller, responsive to a receipt of the accelerometer signal that occurs before a receipt of the dispensing signal, waking the handheld system from the sleep mode and operating the handheld system in an open loop mode, wherein operating the handheld system in the open loop mode comprises the controller issuing at least one control signal to the solid state switch to cause fixed-width pulses of electricity to flow from the battery to the heating coil; and by the controller, responsive to said receipt of the dispensing signal, changing from operating the handheld system in the open loop mode to operating the handheld system in a closed loop mode, wherein operating the handheld system in the closed loop mode comprises modulating width of pulses of electricity flowing from the battery to the heating coil according to a temperature setpoint and feedback provided by the temperature sensor.

3. A handheld system for dispensing heated shaving fluid, comprising:

a battery mounted within the handheld system;

an inlet disposed to receive shaving fluid from a pressurized vessel that contains shaving fluid and that comprises a dispensing valve;

an outlet disposed to emit the heated shaving fluid from the handheld system;

a channel that extends from the inlet to the outlet;

a heating element mounted within the handheld system and in thermal communication with the channel;

a temperature sensor mounted within the handheld system and in thermal communication with the channel;

a predictor that is operative to output a first signal responsive to predicting an occurrence of an event that comprises opening of the dispensing valve;

a sensor mounted within the handheld system and operative to output a second signal responsive to sensing the occurrence of the event; and a plurality of electrical paths respectively extending between the battery and the heating element, the temperature sensor, the predictor, and a controller, wherein the controller is operative to perform a method that comprises:

responsive to receiving the first signal, operating the heating element in a first mode comprising a first power level; and responsive to receiving the second signal, operating the heating element in a second mode comprising a second power level that exceeds the first power level.

4. The handheld system of claim 3, wherein operating the heating element in the first mode comprises heating the heating element in open loop subject to a temperature limit based on a third signal produced by the temperature sensor.

5. The handheld system of claim 4, wherein operating the heating element in the second mode comprises heating the heating element in closed loop using the third signal for feedback.

6. The handheld system of claim 3, wherein operating the heating element in the first mode comprises supplying electricity to the heating element in open loop subject to a time limit and subject to a temperature limit based on a third signal produced by the temperature sensor, wherein operating the heating element in the second mode comprises operating the heating element in closed loop using the third signal for feedback, and wherein the method further comprises:

responsive to receiving the second signal while operating the heating element in the first mode, changing from the first mode to the second mode.

7. The handheld system of claim 3, wherein the heating element comprises four segments of heating coil that extend lengthwise adjacent one another, that are disposed in the channel, and that are connected together in series.

8. The handheld system of claim 3, wherein the heating element comprises a heating coil disposed in the channel.

9. The handheld system of claim 8, wherein the temperature sensor is disposed in the channel downstream from the heating coil.

10. The handheld system of claim 8, wherein the handheld system comprises a pulse width modulator that is operative to modulate electricity flowing from the battery to the heating coil according to a control signal produced by the controller.

11. The handheld system of claim 10, further comprising a receptacle that comprises a catch configured to engage releasably a protruding rim of the pressurized vessel containing shaving fluid, wherein the inlet is centrally disposed in the receptacle and is dimensioned to mate with a nozzle of the pressurized vessel.

12. The handheld system of claim 11, further comprising a watertight recharging port for recharging the battery, wherein the handheld system is watertight with respect to electrical circuitry housed by the handheld system.

13. The handheld system of claim 3, wherein the predictor comprises an accelerometer.

14. The handheld system of claim 3, wherein the predictor comprises a capacitive sensor.

15. The handheld system of claim 3, wherein the predictor comprises a photodetector.

16. The handheld system of claim 3, wherein the predictor comprises a microphone.

17. The handheld system of claim 3, wherein the predictor comprises an antenna.

18. The handheld system of claim 3, wherein the predictor comprises a user-depressible button.

19. The handheld system of claim 3, wherein the predictor comprises:

a clock that measures time;

a memory that stores a user-specified time; and a circuit that produces the first signal when the time that the clock measures is the user-specified time.

* * * * *